US006805052B2

(12) United States Patent
Aert et al.

(10) Patent No.: US 6,805,052 B2
(45) Date of Patent: Oct. 19, 2004

(54) PRINTING SYSTEM WITH A NEGATIVE WORKING THERMAL PLATE FOR ONPRESS DEVELOPMENT

(75) Inventors: Huub Van Aert, Pulderbos (BE); Joan Vermeersch, Deinze (BE); Dirk Kokkelenberg, St. Niklaas (BE)

(73) Assignee: AGFA-Gevaert, Mortsel (BE)

( * ) Notice: Subject to any disclaimer, the term of this patent is extended or adjusted under 35 U.S.C. 154(b) by 0 days.

(21) Appl. No.: 09/996,554

(22) Filed: Nov. 28, 2001

(65) Prior Publication Data

US 2003/0136284 A1 Jul. 24, 2003

Related U.S. Application Data

(60) Provisional application No. 60/264,480, filed on Jan. 26, 2001.

(30) Foreign Application Priority Data

Dec. 20, 2000 (EP) ..... 00000003

(51) Int. Cl.[7] ..... B41C 1/10; B41N 1/14

(52) U.S. Cl. ..... 101/467; 101/457; 101/462

(58) Field of Search ..... 101/456, 457, 101/462, 466, 467; 430/270.1, 302

(56) References Cited

U.S. PATENT DOCUMENTS

| | | | | | |
|---|---|---|---|---|---|
| 4,004,924 | A | * | 1/1977 | Vrancken et al. | 430/325 |
| 5,837,421 | A | * | 11/1998 | Kanda et al. | 430/302 |
| 5,948,591 | A | * | 9/1999 | Vermeersch et al. | 430/270.1 |
| 5,948,599 | A | | 9/1999 | Gardner et al. | 430/330 |
| 6,030,765 | A | * | 2/2000 | Leenders et al. | 430/617 |
| 6,096,481 | A | | 8/2000 | Vermeersch et al. | 430/302 |

FOREIGN PATENT DOCUMENTS

| | | | |
|---|---|---|---|
| EP | 599510 | * | 6/1994 |
| EP | 770494 | * | 5/1997 |
| EP | 849091 | * | 6/1998 |
| EP | 931 647 | * | 7/1999 |
| EP | 1 172 229 | | 1/2002 |
| EP | 1219416 | * | 7/2002 |

* cited by examiner

*Primary Examiner*—Stephen R. Funk
(74) *Attorney, Agent, or Firm*—Joseph T. Guy; Nexsen Pruet LLC

(57) ABSTRACT

A printing system making use of a lithographic printing plate has been disclosed, the system comprising the steps of image-wise exposing to infrared light a heat sensitive imaging element, the element being optionally present on the printing press before starting the image-wise exposing step to infrared light, wherein the element comprises, on a lithographic base with a hydrophilic surface thereupon, an image-forming layer including hydrophobic thermoplastic polymer particles and a hydrophilic polymer binder, and, optionally, an infrared absorbing compound, wherein the hydrophobic polymer particles contain more than 0.1 wt % of nitrogen and have an average particle size diameter in the range from 0.015 to 0.150 $\mu$m; developing the image-wise exposed imaging element by mounting it on a print cylinder of a printing press and applying an aqueous dampening liquid ink to the imaging element while rotating the print cylinder; providing a printing run length of the press, increased with a factor of at least 5, when reducing the average particle size diameter of the hydrophobic polymer particles in an amount of more than 25%.

11 Claims, No Drawings

PRINTING SYSTEM WITH A NEGATIVE WORKING THERMAL PLATE FOR ONPRESS DEVELOPMENT

This application claims the benefit of Provisional application Ser. No. 60/264,480 filed Jan. 26, 2001.

FIELD OF THE INVENTION

The present invention relates to a printing system for on-press development making use of a negative working thermal plate, which has been made sensitive to infrared radiation.

More specifically the present invention is related to the use of a lithographic printing plate showing an improved chemical resistance and lithographic performance, and, more particularly, a higher run length, a broader lithographic latitude and a better scratch resistance, wherein the effects are related with the use of particular hydrophobic polymer particles in an image-forming layer of the heat sensitive imaging element.

BACKGROUND OF THE INVENTION

Lithographic printing plates making use of polymer binders containing nitrogen atoms have been described in various patent applications, as being particularly suitable for use in order to increase the chemical resistance or print durability.

Toyo Gosei Kogyo KK e.g. in the Japanese patent application JP-A 07-036186 makes use of polymers with heterocyclic ring residues containing nitrogen and copolymers of acrylonitrile-butylacrylate-methyl methacrylate and triallyl isocyanurate. Toyo Gosei makes use of photosensitive vinyl acetate emulsion copolymers in combination with an hydrophilic binder, i.e. polyvinyl alcohol. In this application the photsensitive resin compositions are used for an emulsion screen printing plate.

Kodak Polychrome Graphics GMBH, in the PCT patent application filing WO 99/64930, discloses offset printing plates having a high durability. Said plates are composed of a suitable support coated with a positive- or negative-working, or electrophotographic-working radiation-sensitive composition containing an alkali soluble/insoluble thermoplastic polymer that is incorporated into the composition, making use of a solvent in which both the radiation-sensitive polymer and the thermoplastic polymer are soluble and, if required, a second solvent, less volatile than the first solvent, wherein the radiation-sensitive polymer is soluble but wherein the thermoplastic polymer is insoluble. Upon drying the photosensitive layer contains homogeneously distributed polymer particles, providing improved printing durability for the resulting exposed and developed plate. No significant coalescence of particles occurs during imaging. Moreover the photosensitive layer contains a solvent for the employed thermoplastic polymer. Thermoplastics useful in the process are e.g. acrylonitrile-styrene polymers. Just as in the present application styrene-acrylonitrile copolymers were most preferable.

Acidic vinyl copolymers containing acrylonitrile in combination with triazines as a photopolymerization initiator have been described by Mitsubishi Chemical Industries in JP-A 11-249298. Konica, in JP-A 10-207056, makes use of acrylonitrile-benzyl methacrylate-4-hydroxyphenyl-methacrylate-methyl-methacrylate copolymers in order to prepare a lithographic printing plate with improved sensitivity, cleaner resistance and writability. A similar copolymer has been used by Konishiroku Photo Industries in JP-A 08-220766. Okamoto Kagaku Kogyo, in JP-A 05-088369, makes use of alkali-soluble copolymers of N-(4-hydroxyphenyl)maleimide, acrylonitrile, and mono(2-methacryloxyethyl)hexahydrophthalate. The corresponding plates wherein the copolymers are present, show a high photosensitivity, a wide development latitude, and good printing durability, even when using UV-inks. Thus, an anodized aluminum substrate was coated with a component containing naphthoquinon(1,2)-diazido-5-sulfonic acid ester of acetone-pyrogallol resin and acrylonitrile copolymer in order to give a presensitized lithographic plate.

Konica further describes photosensitive compositions comprising naphtoquinone diazide sulphonates and phenolic resins having a good resistance towards cleaners and oils. In JP-A's 63-183441 and 10-207056 Konica makes use of a N-(4-hydroxyphenyl)acrylamide-acrylonitrile-ethyl acrylate-methyl methacrylate copolymer binder.

In JP-A 63-066558 a similar polymer is used in a photosensitive composition containing o-quinone diazide compounds. In JP-A 10-207056 Konica describes a composition comprising (A) a compound generating an acid or a radical under irradiation of light, activated radiation or electron beams and (B) a polymer containing at least one monomer unit (a) with a dipole moment of at least 3.0 D and at least one monomer unit (b) with a dipole moment of less than 3.0 D and having Y=1.800–2.300 (wherein Y is based on an equation, regarding the dipole moment of the monomers and the molar ratio of the monomers, as specified by the author. In JP-A 04-062556 Konica describes a nitrogen-containing polymer in a chemically resistant positive-working resist for presensitized lithographic plates.

Otherwise in JP-A 59-002045 DuPont de Nemours describes the solvent resistance of flexographic plates prepared by making use of a photosensitive elastomer composition containing an acrylonitrile-butadiene copolymer type resin.

A polymer having onium group containing structural components containing one or more onium group(s) is further used in a positive-working presensitized lithographic plate, as disclosed by Fuji in JP-A 10-301262. The lithographic plate shows good performance in erasure of unnecessary image portions, low residual color stain, and high printing durability as well as chemical resistance. In another patent application by Fuji N-containing polymers like Acrylonitrile-N-(p-Aminosulfonylphenyl)-methacrylamide-ethyl methacrylate copolymers are used. The positive-working photosensitive composition for the manufacture of a lithographic plate comprises a polymer with a sulfonamido-group, an alkali-soluble novolak and a positive-working photosensitive compound.

For use of polymer binders in an application such as a negative working lithographic printing plate, improvement of chemical resistance and lithographic performance, and, more particularly, provision of a higher run length, a broader lithographic latitude and a better scratch resistance, is highly desired as it remains an ever lasting demand.

OBJECTS OF THE INVENTION

It is an object of the present invention to provide printing system making use of a negative working lithographic printing plate material, wherein the printing plate material shows an improved chemical resistance and lithographic performance, and, in particular, a higher run length, a lithographic latitude and scratch resistance.

It is a further object to avoid environmentally unfriendly measures in the manufacturing of the printing plate suitable for use in the system, more particularly with respect to the properties of the hydrophobic thermoplastic polymer particles in combination with the hydrophilic polymer binders used therein.

More particularly it is an object of the present invention to provide required solvent resistance on the exposed image areas, while unexposed areas may still give a fast clean-up during the on-press processing of the printing plate in the printing system.

Further advantages and embodiments of the present invention will become apparent from the following description.

SUMMARY OF THE INVENTION

The above mentioned objects are realized by providing in a printing system a heat sensitive imaging element comprising, on a lithographic base with a hydrophilic surface thereupon, an image-forming layer including hydrophobic thermoplastic polymer particles and a hydrophilic (water-soluble, water-dispersable, alkali-dispersable or alkali-soluble) polymer binder, and, optionally, an infrared absorbing compound, characterized in that the hydrophobic polymer particles are containing structural chemical groups selected from the group consisting of amide, urethane, methacrylonitrile, crotononitrile, vinylidene cyanide, isocytosine, pyrrolidone, piperazine, cyanomethyl, cyanoethyl, cyanopropyl, cyanoaryl, cyanoacrylate, primary amines, mono- or di-n-alkyl substituted amines, urea, imide, imine, triazine, sulfonamide, onium, melamine, pyrimidine, ureido-pyrimidone, pyridine, barbiturate, isocyanurate or imidazole.

The printing system according to the present invention makes use therefor of a lithographic printing plate, wherein the system comprises the steps of

- image-wise exposing to infrared light a heat sensitive imaging element, the element being optionally present on the printing press before starting the image-wise exposing step to infrared light, wherein the element comprises, on a lithographic base with a hydrophilic surface thereupon, an image-forming layer including hydrophobic thermoplastic polymer particles and a hydrophilic polymer binder, and, optionally, an infrared absorbing compound, wherein the hydrophobic polymer particles contain more than 0.1 wt % of nitrogen and have an average particle size diameter in the range from 0.015 to 0.150 $\mu$m;
- developing the image-wise exposed imaging element by mounting it on a print cylinder of a printing press and applying an aqueous dampening liquid and/or ink to the imaging element while rotating the print cylinder;
- providing a printing run length of the press, increased with a factor of at least 5, when reducing the average particle size diameter of the hydrophobic polymer particles in an amount of more than 25%.

The lithographic printing plate suitable for use in a printing system of the present invention has also been claimed, as well as use of hydrophobic polymer particles containing more than 0.1 wt. % of nitrogen in a coating (preferably in an image-forming layer) of a heat sensitive imaging element of the lithographic printing plate.

More in particular use in the system of hydrophobic polymer particles containing structural chemical groups selected from the group consisting of amide, urethane, acrylonitrile, vinylcarbazole, methacrylonitrile, crotononitrile, vinylidene cyanide, isocytosine, pyrrolidone, piperazine, cyanomethyl, cyanoethyl, cyanopropyl, cyanoaryl, cyanoacrylate, primary amines, mono- or di-n-alkyl substituted amines, urea, imide, imine, triazine, sulfonamide, onium, melamine, pyrimidine, ureido-pyrimidone, pyridine, barbiturate, isocyanurate or imidazole in a coating of a printing plate (for improving solvent resistance and/or run length) has also been claimed.

Specific features for preferred embodiments of the invention are set out in the dependent claims.

DETAILED DESCRIPTION OF THE INVENTION

With respect to the objects to be attained hydrophobic thermoplastic polymer particles prepared by making use of monomer units or building blocks containing nitrogen, and, more particularly those containing cyano-groups, copolymers of methacrylonitrile give the best results. So a heat sensitive imaging element comprising, on a lithographic base with a hydrophilic surface, an image-forming layer including such hydrophobic thermoplastic polymer particles, will be disclosed below as well as a method for making a lithographic printing plate comprising the steps of image wise exposing to infrared irradiation an imaging element according to the present invention; developing the obtained image-wise exposed imaging element by mounting it on a print cylinder of a printing press and apply an aqueous dampening liquid ink to the imaged imaging element while rotating the print cylinder.

Regarding the objects of the present invention solvent resistance or chemical resistance towards cleaners for offset printing chemicals is obtained by introducing nitrogen atoms in the polymer particles, preferably by means of nitrile groups, amide bonds, urethane bonds, amino groups, in a sufficient amount as described. The solubility of the layer is consequently influenced by the presence of dipole-dipole interactions, hydrogen-bonding interactions or ionic interactions. The presence of a dipole moment in copolymers of cyano-containing monomer units in particular gives a large contribution to an increased solvent resistance. Besides dipole-dipole interactions hydrogen-bonding interactions or ionic interactions, presence of crystallinity in the employed hydrophobic polymer particles may attibute to the obtained chemical resistance, this in particlular for semi-crystalline polyamides, polyurethanes, etc.. Also onium containing structural components give an improved solvent resistance. However, one should take care that interactions between the hydrophilic polymer binder and the hydrophobic thermoplastic particles containing nitrogen, may influence plate performance, as e.g. with polymers containing polyacrylic acid, used as hydrophilic binder, wherein interaction with the thermoplastic particles should be avoided.

When cationic hydrophilic binders or other cationic components are used the water-based dispersions of the polymer particles are preferably stabilized: the colloidal stability of these particles is preferably obtained by making use of non-ionic or cationic surfactants or steric stabilizers (e.g. polyvinyl alcohol). When too much interaction between the hydrophilic binder and the hydrophobic thermoplastic particles is present, staining may occur on the non-imaged areas. In case of on-press processing of the hydrophobic particles and hydrophilic binder, the processing may be inhibited or retarded, due to the interactions. Of course interactions with the lithographic base (e.g. an anodized aluminum plate) may play an additional role in the on-press processing.

In one embodiment or the invention monomer units or building blocks are used which provide multiple-hydrogen bonds. An example of such interactions is the interaction between diacylated 2,6-diamino-pyridines and imide-containing molecules. In addition to the 4-substituted diacylated 2,6-diaminopyridines, 6-substituted diamino-triazines can be used as well. Another example is the complementary binding of thymine derivatives to di-amino triazine and recognition of uracil derivatives by di-amino triazine units. In particular cyano containing polymers give an improved solvent resistance, as, e.g., polymers containing cyano n-alkyl groups. Examples thereof are cyanomethyl (CN—CHR), cyanoethyl (CN—$CH_2$—$CH_2$—R) or cyano-propyl (CN—$CH_2$——$CH_2$—$CH_2$—R). Such cyano—group may be incorporated by polymer modification or by copolymerization of a cyano-containing monomer.

Use of such nitrogen-containing monomers which can give multiple hydrogen bonding has e.g. been described in the following references:

1) Lange,Ronald F. M.; Meijer, E. W.; Macromol.Symp. (1996),102,301-8,
2) Lange,Ronald F. M.; Meijer, E. W.; Belg.Pat.Appl. BE 1007778(1995),
3) Lange,Ronald F. M.; Meijer, E. W.; DSM Research, Geleen, The Neth., Macromolecules (1995), 28(3), 782-3.

A stronger multiple hydrogen-bonding complex can be used based on the ureido pyrimidone unit as described by E. W. Meijer et al:

1) Sijbesma,R. P.; Beijer,F. H.; Brunsveld,L.; Meijer,E. W. PCT Int. Appl. WO 98/14504 A1(1998);
2) Ky Hirschberg,J. H. K.; Beijer,F. H.; van Aert,Huub A.; Magusin, Pieter C. M. M.; Sijbesma, R. P.; Meijer, E. W. Macromolecules (1999), 32(8), 2696–2705;
3) Sijbesma,R. P.; Beijer,F. H.; Brunsveld,L.; Folmer, Brigitte J. B.; Ky Hirschberg, J. H. K.; Lange, R. F. M.; Lowe, J. K. L.; Meijer,E. W. Science (1997), 278 (5343), 1601–1604.

The ureido pyrimidone unit can easily be prepared by reacting a isocytosine with an isocyanate. If a monomer is used with an isocyanate, such as TMI or isocyanatoethylmethacrylate, then a monomer is obtained which could be polymerized by addition polymerization. Such monomers can be used then in an emulsion copolymerisation in order to prepare water-based dispersions of polymer particles containing such ureido pyrimidone units. One can also prepare such hydrogen bonding molecules by endgroup modification, followed by dispersion of the water-insoluble polymer in water. In order to prepare such polymers synthetic procedures as described by Folmer et al. can be used (see Folmer, Brigitte J. B.; Sijbesma, Rint P.; Versteegen, Ron M.; van der Rijt, Joost A. J.; Meijer, E. W. Adv. Mater. (2000), 12(12), 874–878).

The thermoplastic polymer particles containing nitrogen in an amount of more than 0.1% by weight as disclosed in the present invention can be prepared by addition polymerization (e.g. free-radical emulsion copolymerization) or by condensation polymerization (e.g. polyurethanes, polyamides, polyamines, polyimides, polyimines, polyureas, etc.). The hydrophobic polymer particles used in the imaging element according to the present invention are prepared by means of monomers, or building blocks, consisting of the group of compounds having following structural formulae:

Acrylonitrile: CAS No. 107-13-1

$H_2C{=}CH{-}C{\equiv}N$

Methacrylonitrile: CAS No. 4786-20-3

$H_3C{-}CH{=}CH{-}C{\equiv}N$

Crotononitrile, CAS No. 4786-20-3

$H_3C{-}CH{=}CH{-}C{\equiv}N$

Vinylidene cyanide, CAS No. 922-64-5

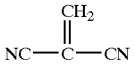

(2-Allyl-2-methylhydrazino)- Acetonitrile, CAS No. 16142-44-2

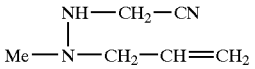

2-Cyanoethyl acrylate, CAS No. 106-71-8

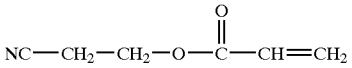

Maleimide, CAS No. 541-59-3

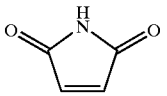

N-Phenylmaleimide, CAS No. 941-69-5

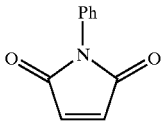

N-Ethylmaleimide, CAS No. 128-53-0

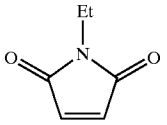

6-Methylisocytosine, CAS No. 3977-29-5

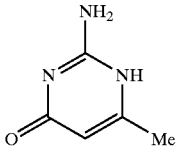

1-[1-(3-isopropenyl-phenyl)-1-methyl-ethyl]-3-(6-methyl-4-oxo-1,4-dihydro-pyrimidine-2-yl) urea

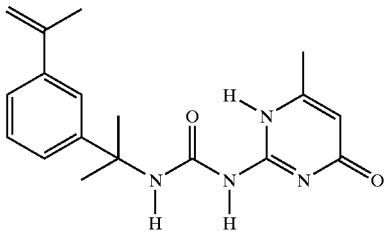

2-methyl-acrylic acid-2-[3-(6-methyl-4-oxo-1,4-dihydro-pyrimidin-2-yl) ureido] ethyl ester

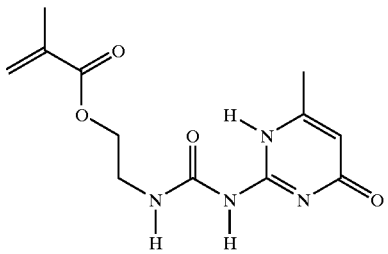

-continued

Hexamethylene-α,ω-bis(methacryloyloxyethyl)urethane, CAS No. 34100-36-2

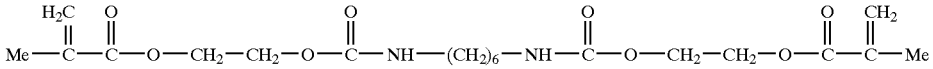

2-Propenoic acid, 2-methyl-, 4,10-dioxo-5,9-dioxa-3,11-diazatridecane-1,13-diyl ester, CAS No. 51265-06-6

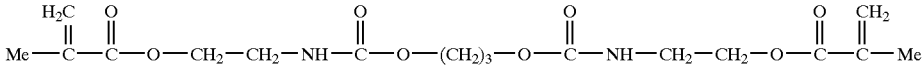

2-Propenoic acid, 2-methyl-, 1,4-phenylenebis(oxycarbonylimino-2,1-ethanediyl) ester, CAS No. 51265-08-8

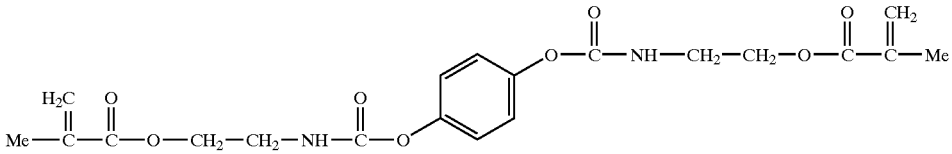

2-Propenoic acid, 2-methyl-, 1,3-phenylenebis(oxycarbonylimino-2,1-ethanediyl) ester, CAS No. 51265-09-9

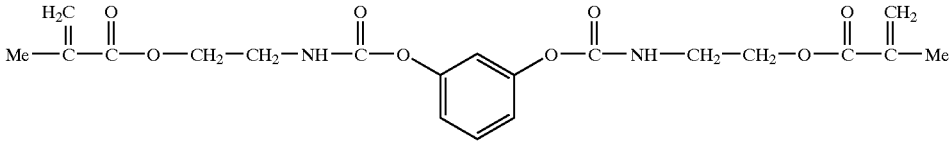

2-Propenoic acid, 2-methyl-, 4,11-dioxo-5,10-dioxa-3,12-diazatetradecane-1,14-diyl ester, CAS No. 51370-12-8

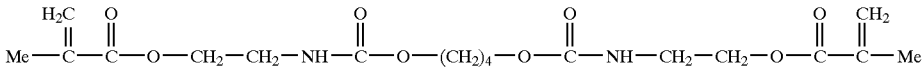

2-Propenoic acid, 2-methyl-, (2-methyl-1,4-phenylene)bis[iminocarbonyloxy(2-methyl-2,1-ethanediyl)] ester, CAS No. 127323-73-3

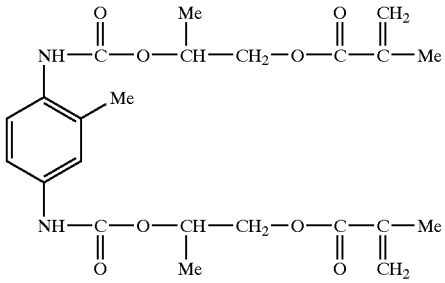

N,N′-(4,4′-Diphenylmethane)bismaleimide, CAS No. 13676-54-5

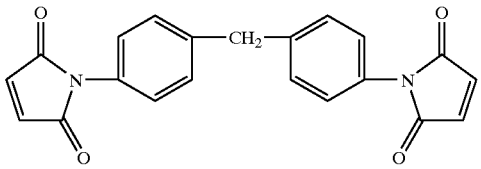

N-Methylmaleimide, CAS No. 930-88-1

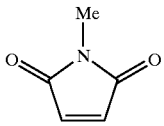

N-(2-Hydroxyethyl)maleimide, CAS No. 1585-90-6

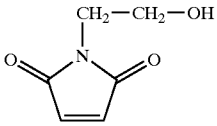

N-(p-Hydroxyphenyl)maleimide, CAS No. 7300-91-6

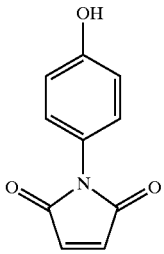

N-4-Tolylmaleimide, CAS No. 1631-28-3

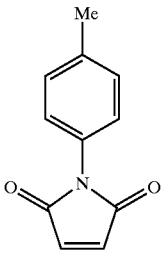

-continued m-Phenylenebismaleimide, CAS No. 3006-93-7

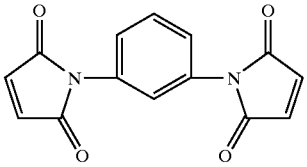

Carbamic acid, [5-[[[[2-(2,5-dihydro-2,5-dioxo-1H-pyrrol-1-yl)ethoxy]carbonyl]amino]methyl]-3,3,5-trimethylcyclohexyl]-, 2-(2,5-dihydro-2,5-dioxo-1H-pyrrol-1-yl)ethyl ester, CAS No. 203193-13-9

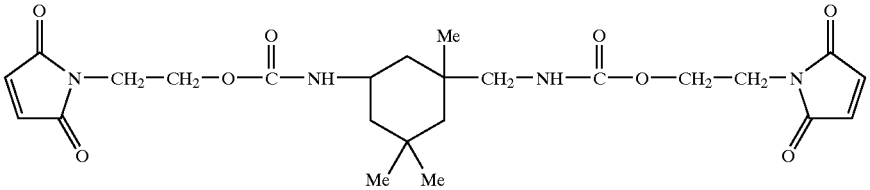

N-(2,4,6-Trichlorophenyl)maleimide, CAS No. 13167-25-4

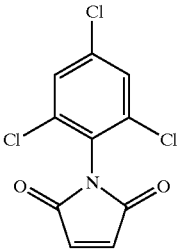

N-Maleimidoglycine, CAS No. 25021-08-3

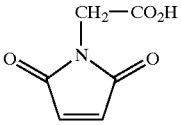

5-Vinyl-2-picoline, CAS No. 140-76-1

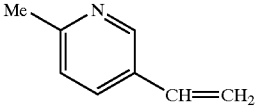

4,6-Diamino-2-vinyl-2-triazine, CAS No. 3194-70-5

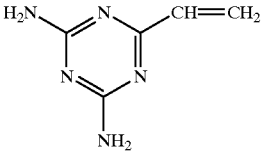

Carbamic acid, [3-(1-methylethenyl)phenyl]-, 2-ethylhexyl ester, CAS No. 152419-01-7

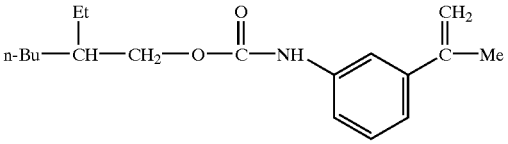

2-Propenoic acid, 2-methyl-, 2-[[[2,2,2-trifluoro-1-(trifluoromethyl)ethoxy]carbonyl] amino]ethyl ester, CAS No. 137130-28-0

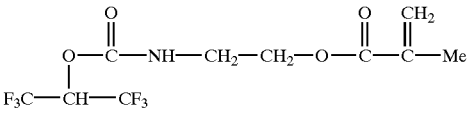

p-Maleimidobenzoic acid, CAS No. 17057-04-4

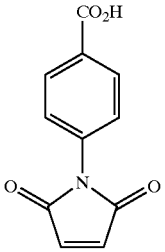

2-Vinylpyridine, CAS No. 100-69-6

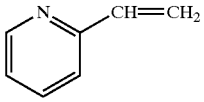

N,N′, N″-Triallylmelamine, CAS No. 30360-21-5

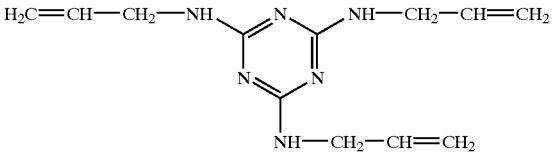

4-Vinylpyridine, CAS No. 100-43-6

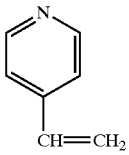

Carbamic acid, [3-(1-methylethenyl)phenyl]-, methyl ester, CAS No. 152418-98-9

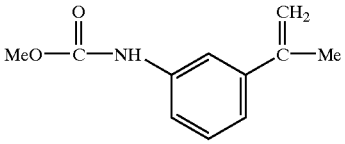

2-Propenoic acid, 2-methyl-, 2-[[(2-hydroxyethoxy)-carbonyl]amino]ethyl ester, CAS No. 151362-30-0

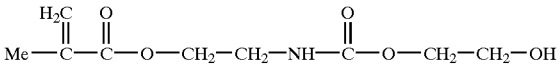

-continued

2-Propenoic acid, 2-methyl-, 2-[[(2,2,2-trifluoroethyoxy)carbonyl]-amino]ethyl ester, CAS No. 103527-92-0

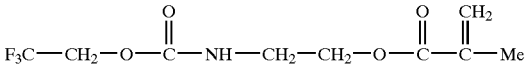

α-[[[2-[(2-methyl-1-oxo-2-propenyl)oxy]ethyl]amino]-carbonyl]-ω-propoxy- Poly(oxy-1,2-ethanediyl), CAS No. 280569-16-6

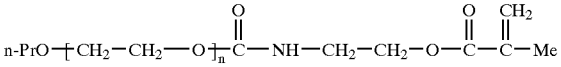

2,4,6-Tris(allyloxy)-s-triazine, CAS No. 101-37-1

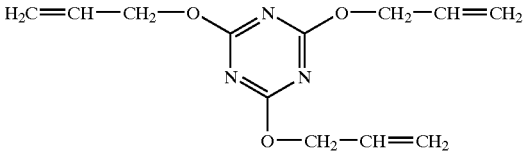

1,3,5-Triazine, 2-ethenyl-, CAS No. 45589-18-2

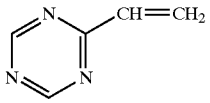

N,N-Dimethylpropenamide, CAS No. 2680-03-7

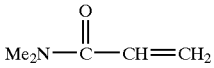

N-Methylolacrylamide, CAS No. 924-42-5

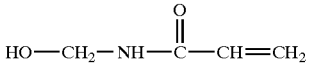

p-Methacrylamidophenol, CAS No. 19243-95-9

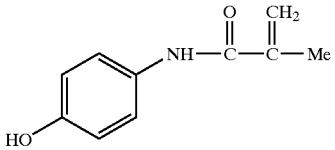

N-[(4-methylphenyl)sulfonyl]- 2-Propenamide, CAS No. 131290-90-9

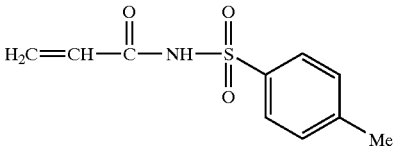

α-[[[1-methyl-2-[(2-methyl-1-oxo-2-propenyl)oxy]ethyl]amino]-carbonyl]-ω-methoxy- Poly(oxy-1,2-ethanediyl), CAS No. 178490-91-0

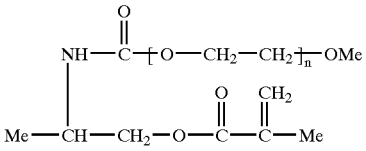

N-Vinyl-2-pyrrolidone, CAS No. 88-12-0

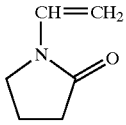

2-Allylamino-4,6-dichloro-s-triazine, CAS No. 30369-80-3

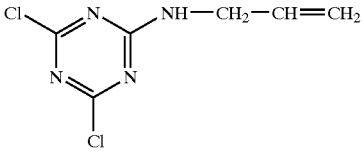

N-Isopropylpropenamide, CAS No. 2210-25-5

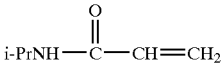

N,N′-Methylenediacrylamide, CAS No. 110-26-9

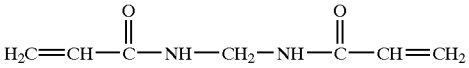

Diacetone acrylamide, CAS No. 2873-97-4

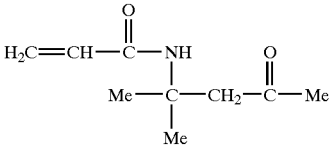

4-Methacrylamidobenzenesulfonamide, CAS No. 56992-87-1

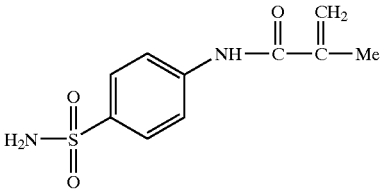

N-(p-Aminosulfonylphenyl)acrylamide, CAS No. 2621-99-0

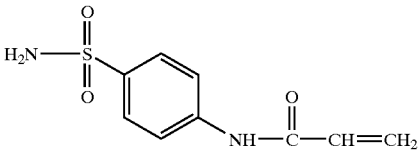

-continued 4-(2,5dihydro-2,5-dioxo-1H-pyrrol-1-yl)-N-(4,6-dimethyl-2-pyrimidinyl)- Benzenesulfonamide, CAS No. 233761-16-5

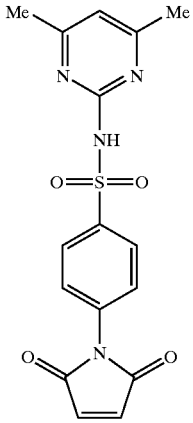

4-(2,5-dihydro-2,5-dioxo-1H-pyrrol-1-yl)- Benzenesulfonamide, CAS No. 7300-97-2

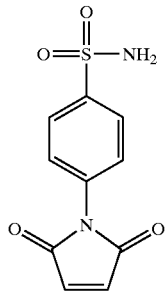

N-(N-Acetyl-p-sulfamoylphenyl)maleimide, CAS No. 1886-78-8

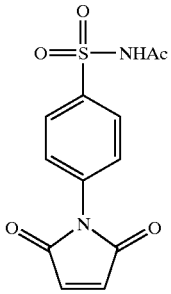

N-Methacryloylphthalimide, CAS No. 40459-78-7

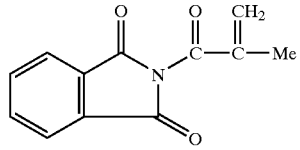

Isophorone diisocyanate, CAS No. 4098-71-9

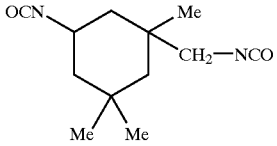

Tolylene isocyanate, CAS No. 26471-62-5

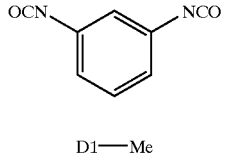

Hexane 1,6-diisocyanate, CAS No. 822-06-0

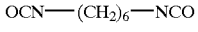

p,p′-Methylenebis(phenyl isocyanate), CAS No. 101-68-8

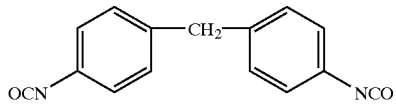

Methylenedi-4-cyclohexylene diisocyanate, CAS No. 5124-30-1

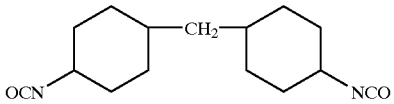

p-Tetramethylxylylene diisocyanate, CAS No. 2778-41-8

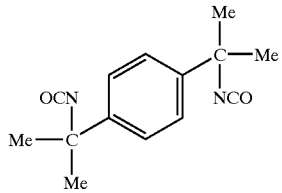

m-Isopropenylcumyl isocyanate, CAS No. 2094-99-7

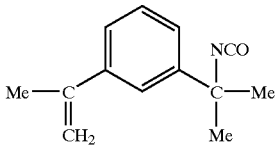

N-(2-Aminoethyl)ethylenediamine, CAS No. 111-40-0

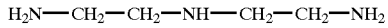

-continued

Urea, CAS No. 57-13-6

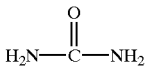

Hexamethylenediamine, CAS No. 124-09-4

$H_2N—(CH_2)_6—NH_2$

Methylenedianiline, CAS No. 101-77-9

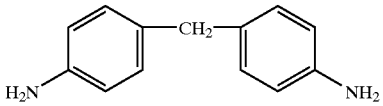

N-Succinimidyl acrylate, CAS No. 38862-24-7

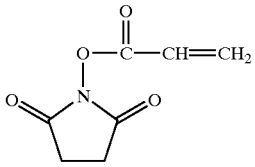

N-[2-(Dimethylamino)ethyl]methacrylamide, CAS No. 13081-44-2

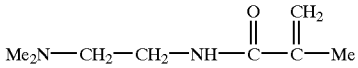

[2-(Methacryloyloxy)ethyl]trimethylammonium chloride, CAS No. 5039-78-1

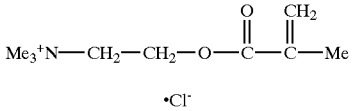

N-[3-(Dimethylamino)propyl]acrylamide, CAS No. 3845-76-9

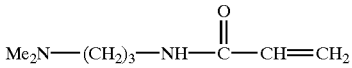

N-Benzylmethacrylamide, CAS No. 3219-55-4

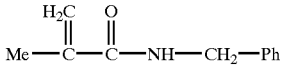

N,N-Diemthylacrylamide, CAS No. 2680-03-7

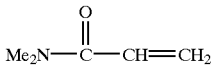

Diemthylaminoethyl acrylate, CAS No. 2439-35-2

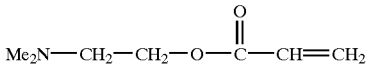

Adipic acid, dihydrazide, CAS No. 1071-93-8

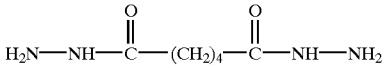

Melamine, CAS No. 108-78-1

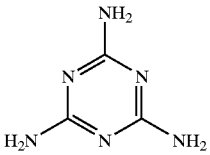

N,N-diethanolamine, CAS No. 111-42-2

$HO—CH_2—CH_2—NH—CH_2—CH_2—OH$

Benzyl(methacryloyloxyethyl)dimethylammonium chloride, CAS No. 46917-07-1

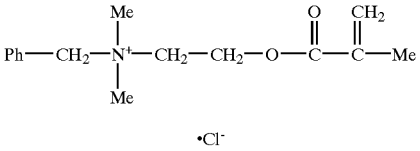

1,4-Dimethacryloylpiperazine, CAS No. 17308-56-4

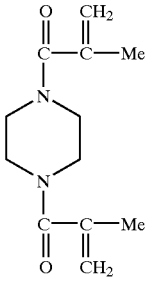

N-[3-(N,N-Dimethylamino)propyl]methacrylamide, CAS No. 5205-93-6

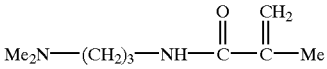

N-iso-Butoxymethylmethacrylamide, CAS No. 4548-27-0

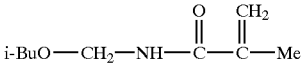

N-tert-Butylaminoethyl methacrylate, CAS No. 3775-90-4

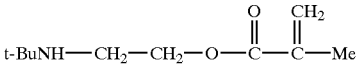

N,N-Dimethylethanolamine methacrylate, CAS No. 2867-47-2

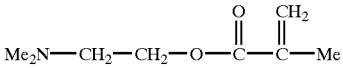

N,N-Diethylacrylamide, CAS No. 2675-94-7

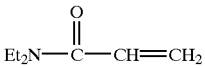

m-Isopropenylcumyl isocyanate, CAS No. 2094-99-7

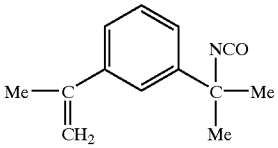

Dihydroxyethylenebis(acrylamide), CAS No. 868-63-3

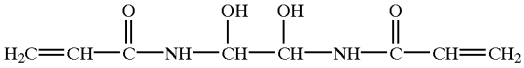

-continued tert-Butylacrylamide, CAS NO. 107-58-4

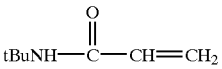

N,N-Diethylaminoethyl methacrylate, CAS No. 105-16-8

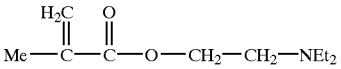

N-[3-(Dimethylamino)propyl]acrylamide, CAS No. 3845-76-9

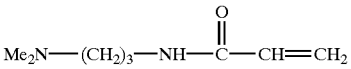

Trimethylenediamine, CAS No. 109-76-2

$H_2N—CH_2—CH_2—CH_2—NH_2$ 1,4-Butanediamine, CAS No. 110-60-1

$H_2N—(CH_2)_4—NH_2$ 1-ethenyl-3-methyl-1H-Imidazolium, CAS No. 45534-45-0

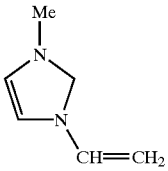

2-Cyanoethyl acrylate, CAS No. 106-71-8

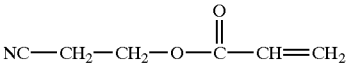

p-Cyanostyrene, CAS No. 3435-51-6

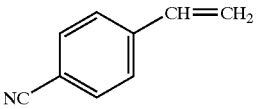

2-Cyanoethyl vinyl ether, CAS No. 15678-32-7

$H_2C═CH—O—CH_2—CH_2—CN$

3-Bromopropionitrile, CAS No. 2417-90-5

$Br—CH_2—CH_2—C≡N$ 3,4-Epoxybutyronitrile, CAS No. 624-58-8

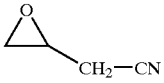

3-Hydroxypropionitrile, CAS No. 109-78-4

$HO—CH_2—CH_2—C≡N$

Caprolactam, CAS No. 105-60-2

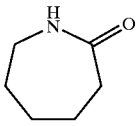

N-Methacryloylmorpholine, CAS No. 5117-13-5

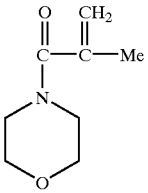

Ethylenimine, CAS No. 151-56-4

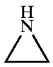

1,2-Ethanediamine, CAS No. 107-15-3

$H_2N—CH_2—CH_2—NH_2$

Vinylimidazole, CAS No. 29383-23-1

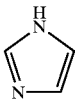

$D1—CH═CH_2$

Cyanoethyl methacrylate, CAS No. 4513-53-5

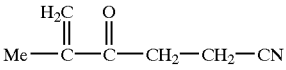

N-(3-Aminopropyl)methacrylamide, CAS No. 86742-39-4

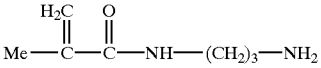

3-Ethoxyacrylonitrile, CAS No. 61310-53-0

$EtO—CH═CH—CN$

Propanoic acid, 3-cyano- ethenyl ester, CAS No. 160745-18-6

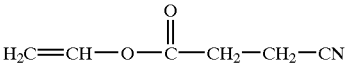

3-Chloropropionitrile, CAS No. 542-76-7

$Cl—CH_2—CH_2—C≡N$

3-Aminopropionitrile, CAS No. 151-18-8

$H_2N—CH_2—CH_2—C≡N$

4-Cyanobutyric acid, CAS No. 39201-33-7

$NC—(CH_2)_3—CO_2H$

As can be derived from the structures given above, the nitrogen atom may be introduced via the monomer or another building block in the preparation of the hydrophobic thermoplastic polymer particles.

The nitrogen atoms may also be introduced via surfactants containing nitrogen atoms, used in order to stabilize aqueous dispersions or via absorption on the surface of the thermoplastic polymer particle of polymers containing nitrogen atoms. The thermoplastic polymer particles as described are, in a preferred embodiment of the present invention, applied as water based dispersions. The water-based dispersions of the hydrophobic thermoplastic polymer particles of the present invention can be prepared by polymerization in a water-based system, e.g. by emulsion polymerization, or by means of dispersing techniques of the water-insoluble polymers into water.

The the polymer particles can be dispersed in water by several techniques, well-known in the art, as e.g. by dispersing a solid polymer particle, making use therefor of surfactants or other stabilizing agents, or by evaporating a water-based polymer emulsion, containing a water-immiscible organic solvent (as e.g ethyl acetate).

According to the present invention a printing system is thus provide with a heat sensitive imaging element, wherein the element comprises, on a lithographic base with a hydrophilic surface, an image-forming layer including hydrophobic thermoplastic polymer particles, a hydrophilic polymer binder and a compound absorbing infrared radiation, coated in the image forming layer or in a layer adjacent thereto, characterized in that the hydrophobic polymer particles are containing chemical groups or units in their structure, the groups or units being selected from the group consisting of amide, urethane, methacrylonitrile, cyanoethyl, cyanoacrylate, primary amines, mono- or di-n-alkyl substituted amines, urea, imide, imine, triazine, sulfonamide, onium, melamine, pyrimidine, ureido-pyrimidone, pyridine, barbiturate, isocyanurate and imidazole.

In a preferred embodiment of the present invention the heat-sensitive imaging element contains a hydrophilic polymer binders which are water-soluble, water-dispersable, alkali-dispersable or alkali-soluble.

In another embodiment the heat sensitive imaging element used in the printing system according to the present invention has hydrophobic thermoplastic polymer particles consisting of a homopolymer or copolymer of monomers selected from the group consisting of styrene, tert.-butylstyrene, methylmethacrylate, para-methylstyrene, methacrylonitrile, N-alkyl substituted acrylamides, N-alkyl substituted methacrylamides and maleimides.

In a further preferred embodiment in the heat sensitive imaging element of the printing system according to the present invention the hydrophobic thermoplastic polymer particles are containing nitrile groups and, even more preferably, the heat sensitive imaging element has hydrophobic thermoplastic polymer particles consisting of a homopolymer or copolymer of methacrylonitrile.

In another embodiment the heat sensitive imaging element used in the printing system according to the present invention has hydrophobic thermoplastic polymer particles consisting of a homopolymer or copolymer selected from the group of polymer types consisting of polyurethanes, polyamides, polyamines, polyureas and polyimides.

The imaging element used in the printing system of the present invention further preferably has hydrophobic thermoplastic particles having nitrogen-containing units which form multiple hydrogen bonds, and more preferably, the thermoplastic particles have ureido pyrimidone units.

In a preferred embodiment of the present invention the imaging material used in the printing system according to the present invention has hydrophobic polymer particles having an average particle size diameter of less than 0.5 $\mu$m, and even more preferably an average particle size diameter in the range from 0.015 to 0.150 $\mu$m.

According to the present invention the imaging element used in the printing system of the present invention has hydrophobic thermoplastic polymer particles which are present in the image forming layer in an amount of at least 50 wt. %.

In another preferred embodiment the imaging element of the printing system according to the present invention has a hydrophilic binder polymer which is present in the image forming layer and/or a layer adjacent thereto.

In the imaging element of the system according to the present invention the hydrophilic polymer binder present in the image forming layer and/or a layer adjacent thereto more preferably contains carboxylic acid groups.

In another embodiment the hydrophilic polymer binder which is present in the image forming layer and/or a layer adjacent thereto in the imaging element of the system according to the present invention, contains acrylic acid, methacrylic acid, itaconic acid, crotonic acid or maleic acid moieties.

The imaging element in the printing system according to the present invention, if having an infrared absorbing compound, has an infrared absorbing compound being an anionic infrared cyanine dye absorbing infrared radiation in the wavelength range from 800 to 1100 nm. In a preferred embodiment, in the imaging element of the printing system according to the present invention, the infrared absorbing compound is present in the image forming layer or in a layer adjacent thereto. The image forming layer and/or a layer adjacent thereto thus comprises, in accordance with the present invention, an anionic infrared(IR) cyanine dye, which serves as a light to heat converting compound. A mixture of anionic infrared-cyanine dyes may be used, but it is preferred to use only one anionic IR-cyanine dye. Particularly useful anionic IR-cyanine dyes are IR-cyanines dyes with at least two sulphonic groups. Still more preferably are IR-cyanines dyes with two indolenine and at least two sulphonic acid groups. Most preferable is compound (I) having a chemical structure as given hereinafter.

(I)

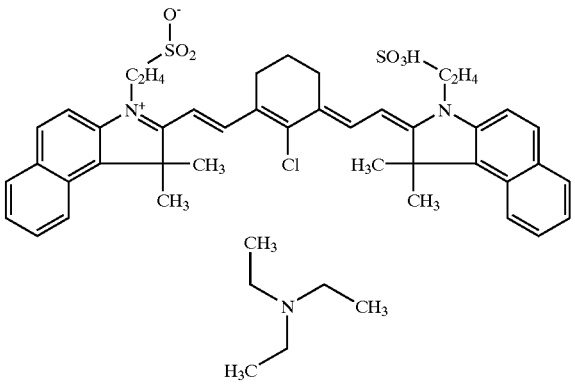

Also the compound (II) having a structure as indicated furtheron, gives good results.

(II)

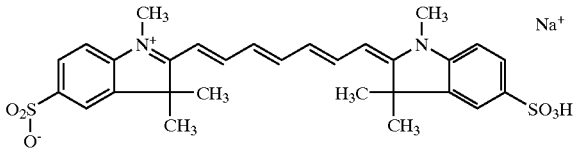

The amount of anionic IR-cyanine dye contained in the image-forming layer is preferably between 1% by weight and 40% by weight, more preferably between 2% by weight and 30% by weight and even most preferably between 5% by weight and 20% by weight of the image-forming layer.

In a preferred embodiment of the printing system according to the present invention the imaging element has a surface, wherein the surface is a lithographic surface, present on a metal support, being a plate or a print cylinder, and wherein, in a further preferred embodiment the metal support is anodized aluminum.

According to the present invention the printing system makes use of a lithographic printing plate, wherein the system comprises the steps of image-wise exposing to infrared light an imaging element as disclosed hereinbefore;

developing the image-wise exposed imaging element by mounting it on a print cylinder of a printing press and applying an aqueous dampening liquid ink to the imaging element while rotating the print cylinder;

providing a printing run length of the press, increased with a factor of at least 5, when reducing the average particle size diameter of the hydrophobic polymer particles in an amount of more than 25%.

More preferred in the printing system according to the present invention is that the lithographic printing plate is image-wise exposed to infrared light, that the imaging element is a heat sensitive imaging element, wherein the element is optionally present on the printing press before starting the image-wise exposing step to infrared light, and wherein the element comprises, on a lithographic base with a hydrophilic surface thereupon, an image-forming layer including hydrophobic thermoplastic polymer particles and a hydrophilic polymer binder, and, optionally, an infrared absorbing compound, wherein the hydrophobic polymer particles contain more than 0.1 wt % of nitrogen and have an average particle size diameter in the range from 0.015 to 0.150 $\mu$m.

To summarize: use in a printing system of a heat-sensitive lithographic printing plate containing hydrophobic thermoplastic polymer particles as disclosed, in combination with a hydrophilic polymer binder in a plate, based on image-wise fusing of polymer particles has never been described until now.

The objects of the present invention are moreover fully obtained as will be illustrated hereinafter in the examples, after image-wise exposure to infrared radiation of a heat-sensitive lithographic printing plate or element in the printing system according to the present invention and subsequent development by mounting it on a print cylinder of a printing press, applying thereupon an aqueous dampening liquid ink to the image imaging element while rotating the print cylinder. Making use of image-wise fusing of hydrophobic thermoplastic polymer particles containing nitrogen in an amount as set forth in the present invention, clearly gives an improved solvent resistance on the infrared-exposed areas, while the non-exposed areas are developed on-press and the lithographic aluminum base with very good hydrophilicity is set free. Use of a hydrophilic polymer binder, such as polyacrylic acid, polyvinyl alcohol or acrylic acid copolymers, gives a fast clean-up during the on-press processing, even though the polymer particles have a very low solubility.

As has been disclosed in EP-A 0 849 091 polyacrylonitrile and polyvinylcarbazole are very useful polymers providing hydrophobic thermoplastic polymer particles having an average particle size of from 40 nm to 150 nm in order to guarantee excellent printing properties and convenient ecological development of lithographic printing plates and to provide a heat sensitive imaging element for making lithographic printing plates with an improved sensitivity, a high throughput and less scumming. At the time when that application was filed, the effect on solvent resistance as intensively studied now, was not known and only within the context of the system according to the present invention, it has been confirmed that also acrylonitrile and vinylcarbazole monomers give rise to hydrophobic polymers with an improved solvent resistance and/or run length for imaging elements.

Use of hydrophobic polymer particles containing more than 0.1 wt. % of nitrogen in a coating of a printing plate for improving solvent resistance and/or run length in the printing system of the present invention has also been claimed and more particularly use of hydrophobic polymer particles containing more than 0.1 wt. % of nitrogen in an image-forming layer of a heat sensitive imaging element, for improving solvent resistance and/or run length.

According to the printing system of the present invention use in the imaging element is envisaged of hydrophobic polymer particles containing structural chemical groups selected from the group consisting of amide, urethane, acrylonitrile, vinylcarbazole, methacrylonitrile, crotononitrile, vinylidene cyanide, isocytosine, pyrrolidone, piperazine, cyanomethyl, cyanoethyl, cyanopropyl, cyanoaryl, cyanoacrylate, primary amines, mono- or di-n-alkyl substituted amines, urea, imide, imine, triazine, sulfonamide, onium, melamine, pyrimidine, ureidopyrimidone, pyridine, barbiturate, isocyanurate or imidazole in a coating of a printing plate for improving solvent resistance and/or printing run length.

The present invention will, in the examples hereinafter, be described in connection with preferred embodiments thereof, but it will be understood that it is not intended to limit the invention to those embodiments.

EXAMPLES

Example 1

Preparation of the Lithographic Base

A 0.30 mm thick aluminum foil was degreased by immersing the foil in an aqueous solution containing 5 g/l of sodium hydroxide at 50° C. and rinsed with demineralized water. The foil was then electrochemically grained using an alternating current in an aqueous solution containing 4 g/l of hydrochloric acid, 4 g/l of hydroboric acid and 5 g/l of aluminum ions at a temperature of 35° C. and a current density of 1200 A/m$^2$ in order to form a surface topography with an average center-line roughness Ra of 0.5 mm.

After rinsing with demineralized water the aluminum foil was then etched with an aqueous solution containing 300 g/l of sulfuric acid at 60° C. for 180 seconds and rinsed with demineralized water at 25° C. for 30 seconds.

The foil was subsequently subjected to anodic oxidation in an aqueous solution containing 200 g/l of sulfuric acid at a temperature of 45° C., a voltage of about 10 V and a current density of 150 A/m$^2$ for about 300 seconds to form an anodic oxidation film of 3.00 g/m$^2$ of $Al_2O_3$, then washed with demineralized water and post-treated with a solution containing polyvinyl phosphonic acid, rinsed with demineralized water at 20° C., during 120 seconds, follwed by drying.

Preparation of the Imaging Elements

An imaging element was produced by preparing the following (comparative) coating composition 1, which was coated onto the lithographic base described above, in an amount of 30 g/m$^2$ (wet coating amount), followed by drying at 35° C., resulting in a dry layer coating having a thickness of 0.8 $\mu$m.

Imaging elements 2–12 according to the invention were produced in a similar way, making use from the coating compositions 2–12, described below.

Preparation of the Coating Composition 1 (Comparative Composition)

To 10.0 g of a 20 wt. % dispersion of a poly(styrene) homopolymer having a particle size diameter of 75 nm, which was stabilized with a surfactant (1.5 wt. % vs. the polymer) in deionized water was added 26.7 g of a 1 wt. % solution of compound I.

To the solution solution described above was added 36.1 g of deionized water and 26.7 g of a 1.5 wt. % solution of Glascol E15 (polyacrylic acid, commercially available from Allied Colloids Ltd., UK). Furthermore 0.5 ml of a fluor substituted surfactant solution was added (5 wt. % of a solution of tetra-ethylammonium n-perfluoro-octane sulfonate in water/ethanol 50/50).

Preparation of the Coating Composition 2 (Inventive)

To 10.0 g of a 20 wt. % dispersion of poly(styrene-co-acrylonitrile) (having a styrene/acrylonitrile weight ratio of 95/5; with a particle size diameter of 70 nm) stabilized with a surfactant (1.5 wt. % vs. polymer) in deionized water was added 26.7 g of a 1 wt. % solution of compound I.

To the above obtained solution was added 36.1 g of deionized water and 26.7 g of a 1.5 wt. % solution of Glascol E15 (polyacrylic acid commercially available from Allied Colloids Ltd., UK). Furthermore 0.5 ml of a fluor substituted surfactant solution was added (5 wt. % solution of tetra-ethylammonium n-perfluoro-octane sulfonate in water/ethanol 50/50).

Preparation of the Coating Composition 3 (Inventive)

To 10.0 g of a 20 wt. % dispersion of poly(styrene-co-acrylonitrile) (having a styrene/acrylonitrile weight ratio of 85/15; and a particle size diameter of 60 nm) stabilized with a surfactant (1.5 wt. % vs. polymer) in deionized water, was added 26.7 g of a 1 wt % solution of compound I.

To the above obtained solution was added 36.1 g of deionized water and 26.7 g of a 1.5 wt. % solution of Glascol E15 (polyacrylic acid commercially available from Allied Colloids Ltd., UK). Furthermore 0.5 ml of a fluor substituted surfactant solution was added (5 wt. % solution of tetra-ethylammonium n-perfluoro-octane sulfonate in water/ethanol 50/50).

Preparation of the Coating Composition 4 (Inventive)

To 10.0 g of a 20 wt. % dispersion of poly(styrene-co-acrylonitrile) (having a styrene/acrylonitrile weight ratio of 66.3/33.7; and a particle size diameter of 60 nm) stabilized with a surfactant (1.5 wt. % vs. polymer) in deionized water was added 26.7 g of a 1 wt. % solution of compound I.

To the above obtained solution was added 36.1 g of deionized water and 26.7 g of a 1.5 wt. % solution of Glascol E15 (polyacrylic acid commercially available from Allied Colloids Ltd., UK). Furthermore 0.5 ml of a fluor substituted surfactant solution was added (5 wt. % solution of tetra-ethylammonium n-perfluoro-octane sulfonate in water/ethanol 50/50).

Preparation of the Coating Composition 5 (Inventive)

To 10.0 g of a 20 wt. % dispersion of poly(styrene-co-acrylonitrile) (having a styrene/acrylonitrile weight ratio of 66.3/33.7; and a particle size diameter of 50 nm) stabilized with a surfactant (1.5% w/w vs. polymer) in deionized water was added 26.7 g of a 1 wt. % solution of compound I.

To the above obtained solution was added 36.1 g of deionized water and 26.7 g of a 1.5 wt. % solution of Glascol E15 (polyacrylic acid commercially available from Allied Colloids Ltd., UK). Furthermore 0.5 ml of a fluor-substituted surfactant solution was added (5 wt. % solution of tetraethylammonium n-perfluoro-octane sulfonate in water/ethanol 50/50).

Preparation of a Printing Plate and Making Copies of the Original

Each of the imaging elements 1–5 as described above was subjected to a scanning diode laser, emitting laser radiation having a wavelength of 830 nm (scan speed: 1 m/s, at 2540 dpi and with a power on the plate surface of 44 mW).

After imaging the plate was processed on a press (Heidelberg GTO46), using Van Son rubberbase VS2329 ink and Rotamatic fountain in order to remove the unexposed areas, resulting in a negative working lithographic printing plate.

Table 1 summarizes the results in terms of sensitivity (expressed in mJ/cm$^2$), run length (the longer, the better) and chemical resistance (the more "+"-signs, the better the resistance).

TABLE 1

| Coat. Composition | Sensitivity | Run length | Chemical resistance |
|---|---|---|---|
| 1 (comp.) | 230 | 9000 | Reference |
| 2 (inv.) | 225 | 9000 | + |
| 3 (inv.) | 225 | >15000 | ++ |
| 4 (inv.) | 235 | >15000 | +++ |
| 5 (inv.) | 225 | >15000 | +++ |

For about the same sensitivity, the run length and chemical resistance was improved to a remarkable extent for the inventive coating compositions.

Chemical resistance against press chemicals was tested by means of a procedure wherein the printing plate which was processed on-press, was brought in contact, during 1 minute, with several chemicals and subsequently wiped off, making use of a wet cotton pad. Subsequently the lithographic plate performance was tested again.

TABLE 2

| Coating | Solvent A75 | Meter X | RC910 | RC95 | G642b |
|---|---|---|---|---|---|
| 1 (comp.) | Image totally removed | Image totally removed | Screen plane slightly Destroyed | Screen plane Destroyed | Screen plane slightly Destroyed |
| 2 (inv.) | Image slightly Destroyed | Almost no image damage | Almost no screen plane damage | Screen plane slightly Destroyed | Almost no screen plane |
| 3 (inv.) | OK | Almost no damage | OK | OK | OK |
| 4 (inv.) | OK | OK | OK | OK | OK |
| 5 (inv.) | OK | OK | OK | OK | OK |

The results for the chemical resistance, obtained by this test, have been summarized in Table 2 above. Increasing amounts of acrylonitrile in the polymer latex clearly provide a better chemical resistance. The image was checked in a full plane area and in a screen plane (grid).

Example 2

Similar coating compositions as in Example 1 were prepared and evaluated, the coatings containing 75 wt. % of water-dispersed poly-mer particles,10 wt. % of IR-dye compound and 15% of polyacrylic acid. The type of polymer particles was varied and compared to a polysty-rene homopolymer emulsion and an emulsion polymer based on styrene/acrylonitrile as used in example 1. Employed polymer types of the thermoplastic particle for compositions 6–12 have been given below.

Comparative coating composition 6 contains a polystyrene homopolymer latex (particle size: 75 nm).

Inventive coating composition 7 contains a styrene/acrylonitrile copolymer (monomer weight ratio styrene/acrylonitrile:64.4/34.7, particle size: 55 nm)

Inventive coating composition 8 contains a styrene/methacrylonitrile copolymer latex (monomer weight ratio styrene/methacrylonitrile:60.8/39.2, particle size: 66 nm)

Inventive coating composition 9 contains a styrene/N-isopropylacrylamide copolymer latex (monomer weight ratio styrene/N-isopropylacrylamide:85/15, particle size: 67 nm).

Inventive coating composition 10 contains a styrene/N-isopropylacrylamide copolymer latex (monomer weight ratio styrene/N-isopropylacrylamide:70/30, particle size: 57 nm).

Comparative coating composition 11 contains a latex based on a styrene/4-(2,5-dihydro-2,5-dioxo-1H-pyrrol-1-yl)-N-(4,6-dimethyl-2-pyrimidinyl)-Benzenesulfonamide copolymer (weight ratio 95/5, particle size: 65 nm)

Comparative coating composition 12 contains a latex based on a copolymer of styrene and N,N',N"-Triallylmelamine (99/1 weight ratio, particle size: 69 nm).

The results obtained for the coating compositions 6–12, have been summarized in Table 3 hereinafter.

The chemical resistance of these printing plates was tested further by treating the plate during 1 minute with several chemicals and subsequently wiping off, using a wet cotton pad. These plates were subsequently tested again in a printing experiment in order to see whether or not the image was damaged.

In the table below an indication has been given of the level of damage due to the solvent treatment (significance of the figures: 1=image totally removed, and/or full plane damaged; 2=full plane=slightly damaged; 3=no damage=OK; 1.5=screen plane damaged, full plane OK; 2.5=screen plane slightly damaged, full plane=OK). The results have been summarized in Table 4 following Table 3 hereinafter.

TABLE 3

| Coating Comp. | Sensitivity mJ/cm$^2$ | Run length | Chemical resistance |
|---|---|---|---|
| 6 (comp.) | 235 | 7000 | Reference |
| 7 (inv.) | 235 | >15000 | +++ |
| 8 (inv.) | 230 | 15000 | +++ |
| 9 (inv.) | 310 | 10000 | ++ |
| 10 (inv.) | >350 | 10000 | ++ |
| 11 (comp.) | 240 | 4000 | + |
| 12 (comp.) | 205 | 4000 | + |

The listed chemicals, such as Solvent A75, Meter X, RC95, RC95, and CR642B are well-known typical aggressive chemicals used in offset printing which could damage the plate.

TABLE 4

| Coating comp. | Solvent A75 | Meter X | RC95 | RC910 | CR642B |
|---|---|---|---|---|---|
| 6 | 0 | 0 | 1.5 | 1.5 | 1.5 |
| 7 | 3 | 3 | 2.5 | 3 | 3 |
| 8 | 3 | 3 | 2.5 | 3 | 3 |
| 9 | 3 | 0 | 2.5 | 3 | 3 |
| 10 | 3 | 1 | 2.5 | 3 | 3 |
| 11 | 1.5 | 2.5 | 1.5 | 1.5 | 1.5 |
| 12 | 0 | 0 | 1.5 | 2.5 | 3 |

The results obtained are fully in accordance with the conclusions to be drawn from those in Table 3, namely, that the coating compositions according to the invention, indicated as "inventive coatings" are fully providing properties as requested in the objects of the present invention.

Example 3

Similar coating compositions as in Example 1 were prepared and evaluated, the coatings containing 75 wt. % of water-dispersed polymer articles,10 wt. % of IR-dye compound and 15% of polyacrylic acid. The type of polymer particles was varied from a polymethyl methacrylate and a polystyrene homopolymer emulsion to an emulsion polymer based on styrene/acrylonitrile as used in example 1 and an evaluation was made of the effect of differing particle sizes (90 nm and 65 nm respectively) for each type. Employed polymer types of the thermoplastic particle for compositions 13–15 have been given below.

Comparative coating composition 13 contains a polymethyl methacrylate latex.

Comparative coating composition 14 contains a polystyrene homopolymer latex.

Inventive coating composition 15 contains a styrene/acrylonitrile copolymer (monomer weight ratio styrene/acrylonitrile:64.4/34.7)

The results obtained for the coating compositions 13–15 with respect to run length as a function of differing particle sizes of the hydrophobic thermoplastic polymer particles (90 nm and 65 nm respectively), have been summarized in Table 5 hereinafter and are illustrative for a run length showing a substantially higher increase in the presence of smaller particles, the more when use is made of a composition as disclosed in the present invention.

Opposite to the comparative coatings 13 and 14, coating 15 moreover shows a higher durability of the printing plate, thanks to a better solvent resistance, besides the normally expected higher sensitivity and the tendency to an increased fog sensitivity.

TABLE 5

| Coating Comp. | Run length 90 nm | Run length 65 nm |
|---|---|---|
| 13 (comp.) | 5000 | 10000 |
| 14 (comp.) | 10000 | 20000 |
| 15 (inv.) | 20000 | >1000000 |

A printing run length increased with a factor of at least 5 is obtained for the inventive coating having nitrogen in an amount of at least 1 wt. % in its small hydrophobic thermoplastic polymer particles when reducing the average particle size diameter in an amount of more than 25%.

Having described in detail preferred embodiments of the current invention, it will now be apparent to those skilled in the art that numerous modifications can be made therein without departing from the scope of the invention as defined in the appending claims.

What is claimed is:

1. Method of printing on a press, providing a printing run length of said press to be increased with a factor of at least 5 versus a reference run length, making use therefore of a lithographic printing plate, said method comprising the steps of:

image-wise exposing to infrared light a heat sensitive imaging element, said element being optionally present on the press before starting said image-wise exposing step to infrared light, wherein said element comprises, on a lithographic base with a hydrophilic surface thereupon, an image-forming layer including hydrophobic thermoplastic polymer particles and a hydrophilic polymer binder, and, optionally, an infrared absorbing compound, wherein said hydrophobic polymer particles contain more than 0.1 wt % of nitrogen and have an average particle size diameter in the range from 0.015 to 0.15 $\mu$m, and wherein said reference run length utilizes reference particles containing no or less than 0.1 wt % of nitrogen, developing the image-wise exposed imaging element by mounting it on a print cylinder of a printing press and applying an aqueous dampening liquid and ink to said imaging element while rotating said print cylinder, starting printing up to said increased run length.

2. Method according to claim 1, wherein said hydrophobic polymer particles contain structural chemical groups selected from the group consisting of amide, urethane, methacrylonitrile, crotonitrile, vinylidene cyanide, isocytosine, pyrrolidone, piperazine, cyanomethyl, cyanoethyl, cyanopropyl, cyanoaryl, cyanoacrylate, primary amines, mono- or di-n-alkyl substituted amines, urea, imide, imine, triazine, sulfonamide, onium, melamine, pyrimidine, ureido-pyrimidone, pyridine, barbiturate, isocyanurate or imidazole.

3. Method according to claim 1, wherein said hydrophilic polymer binder is a water-soluble, water-dispersable, alkali-dispersable or alkali-soluble polymer.

4. Method according to claim 1, wherein the hydrophobic thermoplastic polymer particles consist of a copolymer of monomers selected from the group consisting of styrene, tert.-butylstyrene, methylmethacrylate, peramethylstyrene, methacrylonitrile, N-alkly substituted acrylamides, N-alkyl substituted methacrylamides and maleimides.

5. Method according to claim 1, wherein the hydrophobic thermoplastic polymer particles are present in the image forming layer in an amount of at least 50 wt %.

6. Method according to claim 1, further comprising a second hydrophilic polymer binder in a layer adjacent to said image forming layer.

7. Method according to claim 1, wherein the infrared absorbing compound is an anionic infrared cyanine dye absorbing infrared radiation in the wavelength range from 800 to 1100 nm and wherein the infrared absorbing compound is present in said image forming layer or in a layer adjacent thereto.

8. Method according to claim 1, wherein the hydrophilic surface is a lithographic surface, present on a metal support, being a plate or a print cylinder.

9. Method of printing on a press, said method comprising the steps of:

image-wise exposing to infrared light a heat sensitive lithographic printing plate, wherein said lithographic printing plate comprises:

a lithographic base with a hydrophilic surface thereupon, an image-forming layer including hydrophobic thermoplastic polymer particles and a hydrophilic polymer binder, and, an infrared absorbing compound, wherein said hydrophobic polymer particles contain more than 0.1 wt % of nitrogen and have an average particle size diameter in the range from 0.015 to 0.15 $\mu$m, developing the image-wise exposed printing plate by mounting it on a print cylinder of a printing press and applying an aqueous dampening liquid and ink to said imaging element while rotating said print cylinder, and printing.

10. The method of claim 9 wherein said lithographic printing plate is present on said press prior to said image-wise exposing.

11. Method of printing on a press, said method comprising the steps of:

image-wise exposing to infrared light a heat sensitive lithographic printing plate, wherein said lithographic printing plate comprises:

a lithographic base with a hydrophilic surface thereupon, an image-forming layer including hydrophobic thermoplastic polymer particles and a hydrophilic polymer binder, and, an infrared absorbing compound, wherein said hydrophobic polymer particles contain more than 0.1 wt % of nitrogen and have an average particle size diameter in the range from 0.015 to 0.15 $\mu$m, developing the image-wise exposed imaging element by mounting it on a print cylinder of a printing press and applying an aqueous dampening liquid and ink to said imaging element while rotating said print cylinder, and printing;

with the proviso that said printing is at least 5 times longer than printing when said hydrophobic polymer particles contain less than 0.1 wt % nitrogen and have an average particle diameter more than 0.15 $\mu$m wherein said lithographic printing plate is present on said press prior to said image-wise exposing.

* * * * *